US010883788B2

(12) United States Patent
Marcotte

(10) Patent No.: US 10,883,788 B2
(45) Date of Patent: Jan. 5, 2021

(54) FIREARM ACCESSORY CONNECTION DEVICE

(71) Applicant: Daniel Marcotte, Berwick, ME (US)

(72) Inventor: Daniel Marcotte, Berwick, ME (US)

( * ) Notice: Subject to any disclaimer, the term of this patent is extended or adjusted under 35 U.S.C. 154(b) by 0 days.

(21) Appl. No.: 16/661,418

(22) Filed: Oct. 23, 2019

(65) Prior Publication Data

US 2020/0370852 A1 Nov. 26, 2020

Related U.S. Application Data

(60) Provisional application No. 62/851,933, filed on May 23, 2019.

(51) Int. Cl.
*F41A 21/32* (2006.01)
*F41A 21/48* (2006.01)

(52) U.S. Cl.
CPC ..... *F41A 21/325* (2013.01); *F41A 21/482* (2013.01)

(58) Field of Classification Search
CPC ..... F41A 21/32; F41A 21/325
USPC ..... 89/14.05, 14.4; 42/86
See application file for complete search history.

(56) References Cited

U.S. PATENT DOCUMENTS

| | | | | |
|---|---|---|---|---|
| 1,354,416 | A | 9/1920 | Oliver | |
| 4,510,843 | A | 4/1985 | Rabatin | |
| 4,893,426 | A * | 1/1990 | Bixler | F16B 7/20 403/299 |
| 5,140,893 | A | 8/1992 | Leiter | |
| 5,773,746 | A | 6/1998 | Vaden | |
| 6,412,389 | B2 | 7/2002 | Fluhr | |
| 8,210,087 | B2 | 7/2012 | Latka | |
| 8,997,621 | B1 | 4/2015 | Dater et al. | |
| 9,121,656 | B1 | 9/2015 | McKenzie | |
| 9,175,919 | B2 | 11/2015 | Russell et al. | |
| 9,182,187 | B1 | 11/2015 | Griffith | |
| 9,513,078 | B1 | 12/2016 | Fulton et al. | |
| 9,891,017 | B1 | 2/2018 | Lee | |
| 9,958,227 | B2 | 5/2018 | Whitson | |
| 10,184,745 | B1 * | 1/2019 | Fulton | F41A 21/30 |
| 2005/0115394 | A1 | 6/2005 | Matthews et al. | |
| 2008/0098880 | A1 | 5/2008 | Brugger | |

(Continued)

FOREIGN PATENT DOCUMENTS

| | | |
|---|---|---|
| DE | 20 2013 004 276 | 7/2013 |
| WO | 2013057139 | 4/2013 |

*Primary Examiner* — Bret Hayes
(74) *Attorney, Agent, or Firm* — Lambert Shortell & Connaughton; Gary E. Lambert; David J. Connaughton, Jr.

(57) ABSTRACT

The present disclosure relates to devices configured to facilitate the quick and price connection of muzzle accessories to the discharge end of a rifle barrel, and kits including such connection devices. In accordance with aspects and embodiments, a muzzle accessory connection device is provided comprising a housing having a first end and second end, a body having a first body portion positioned concentrically in and contained within the housing and a second body portion extending concentrically from the first body portion and protruding from the second end of the housing, a spring positioning in the housing and around the first body portion, and a locking ring positioned in the housing and around the first body portion, wherein the device is configured to receive a discharge end of a rifle barrel at the first end of the housing and the second body portion is configured to mate with a muzzle accessory.

17 Claims, 12 Drawing Sheets

(56) References Cited

U.S. PATENT DOCUMENTS

| | | | | |
|---|---|---|---|---|
| 2012/0180623 | A1 | 7/2012 | Graham, II et al. | |
| 2015/0377580 | A1 | 12/2015 | Kress | |
| 2016/0097609 | A1 | 4/2016 | Penchuk | |
| 2017/0184367 | A1* | 6/2017 | Odle | F41A 21/325 |
| 2018/0292164 | A1* | 10/2018 | Thompson | F41A 21/325 |
| 2019/0093974 | A1* | 3/2019 | Smith | F41A 21/325 |
| 2020/0149836 | A1* | 5/2020 | DeJessa | F41A 21/325 |

* cited by examiner

FIREARM ACCESSORY CONNECTION DEVICE

FIELD OF DISCLOSURE

The present disclosure relates to firearms and accessories used therewith. More specifically, the present disclosure relates to devices configured to facilitate the connection of an accessory to the discharge end of a firearm barrel.

BACKGROUND

Long-barrel firearms, generally referred to as rifles, designed for precision shooting often include a threaded portion at the discharge end of the barrel where after-market accessories can be attached to the rifle to enhance user experience. For example, muzzle breaks, laser lights, and suppressors, including both flash and sound suppressors, are used to counteract the physical recoil, visible flash, and audible sound produced by rifles. These accessories generally include corresponding threaded portions that mate with the threated portion of the rifle barrel and attach in a threaded connection.

The threading on the barrel and accessory must however be perfect in order for a given accessory to smoothly attach via the threaded connection. Often however, the threading on accessories does not correspond precisely with the threading on the end of the barrel. This leads to imperfect connections. As a result, the accessory might only connect in an imperfect manner, including for example, in a slightly angular or offset position, blocking a portion of the exiting bullet's trajectory. This leads to exceptionally hazardous shooting conditions. Moreover, improper threading, and or attempts to align accessories by using less than all threads of the threading connection, can result in a less-than secure fits, leading to dangerous disconnection of the accessory when firing.

To ensure that proper, secure, attachment and alignment is achieved, it is therefore often necessary for users to adjust the threading connection of accessories with additional parts. These parts may include shims, washers, and set screws. Using parts to force accessories into proper connection and alignment is tedious and time-consuming and can take hours to achieve proper positioning. However, the force generated by propellant gases during firing acts on the device to cause changes in alignment. The types of parts used to initially align an accessory connection do not facilitate the type of fine-tuning often desired by competition shooters, who require adjustments to be made on the order of degrees between rounds. Moreover, often removing an accessory is equally as difficult as attaching it. Poor threading connections and the addition of parts to aid in achieving connections can cause accessories to become stuck on the barrel. This problem is compounded by the fact that often different metal materials are used for accessories and barrels and heat causes the accessories to expand and contract at rates different (and often faster) than the barrel. Users often switch accessories from one rifle to another and when a hot accessory, i.e., one that has been used, is placed on a cold barrel, the accessory tightens around the barrel making it difficult to remove later. Further compounding the difficulty in removing accessories is the phenomenon of "carbon-lock." Carbon lock, though less common but more troublesome, refers to the situation where carbon left behind from burning gunpowder deposit onto the mount and accessory, causing the two to effectively "fuse" together. Removing accessories can thus require significant effort and force, which may damage the accessory and or the rifle.

There thus exists a need for system to connect accessories to gun barrels quickly and with proper alignment and that allow finer control of the adjustment and alignment of gun barrel accessories.

SUMMARY OF DISCLOSURE

In accordance with aspects and embodiments, a rifle accessory connection device is provided. The device comprises a housing having a first end and second end, a body having a first body portion positioned concentrically in and contained within the housing and a second body portion extending concentrically from the first body portion and protruding from the second end of the housing. The device includes a spring positioned in the housing and around the first body portion and a locking ring positioned in the housing and around the first body portion. In accordance with embodiments, the device is configured to receive the discharge end of a rifle barrel at the first end of the housing and the second body portion is configured to mate with a muzzle accessory. In some embodiments, the locking ring comprises chamfer teeth.

In accordance with aspects and embodiments, a rifle accessory connection kit is provided, the kit comprising a rifle accessory connection device and a rife accessory. The rifle accessory connection device comprises a housing having first end and a second device end, where the first end is configured to receive the discharge end of a rifle barrel and the second end is configured to connect to a rifle accessory, and the device comprises a locking ring have chamfer teeth. The rifle accessory of the kit comprises a first accessory end and a second accessory end, where the first accessory end is configured to connect to the rifle accessory connection device at the second end of the device and the first accessory end comprises an attachment ring having chamfer teeth. The chamfer teeth of the attachment ring are configured to engage the chamfer teeth of the locking ring.

In accordance with aspects and embodiments, a rifle accessory connection kit is provided that comprises a rifle accessory connection device and a muzzle accessory adapter. The rifle accessory connection device comprises a housing having first end and a second device end, where the first end is configured to receive the discharge end of a rifle barrel and the second end is configured to connect to a rifle accessory, and the device includes a locking ring have chamfer teeth. The muzzle accessory adapter of the kit comprises first body portion having a first end and a second end, where the first body portion defines an internal threaded cavity and the second body portion comprises an externally threaded portion. The adapter comprises an attachment ring at the first end of the first body portion that includes chamfer teeth and the first body portion, and second body portion of the adapter define a hollow core. The chamfer teeth of the attachment ring are configured to engage the chamfer teeth of the locking ring.

DETAILED DESCRIPTION

The present disclosure relates to systems having devices constructed and arranged to facilitate the quick and precise attachment of an accessory to the discharge end of the barrel of a rifle. As used herein, a rifle refers to a firearm having a long barrel. The systems and devices disclosed herein are suitable for any long barrel designed for use with internally threaded muzzle accessories, including but not limited to muzzle breaks and suppressors.

Figure 1A:
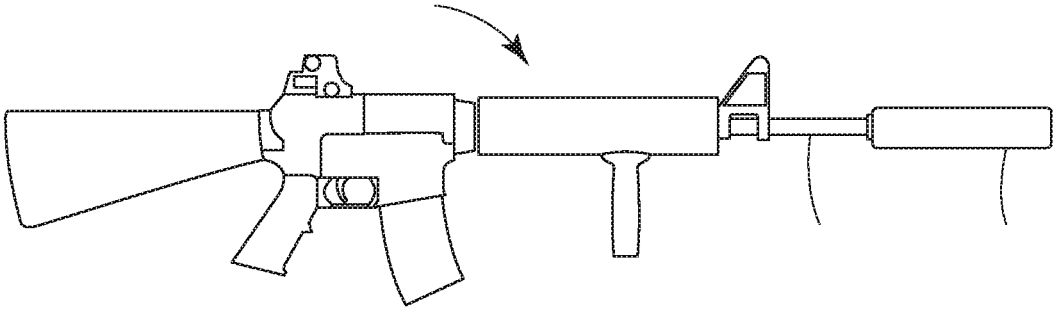
Fig. 1A Prior Art
FIG. 1A shows a prior art rifle.
Figure 1B:
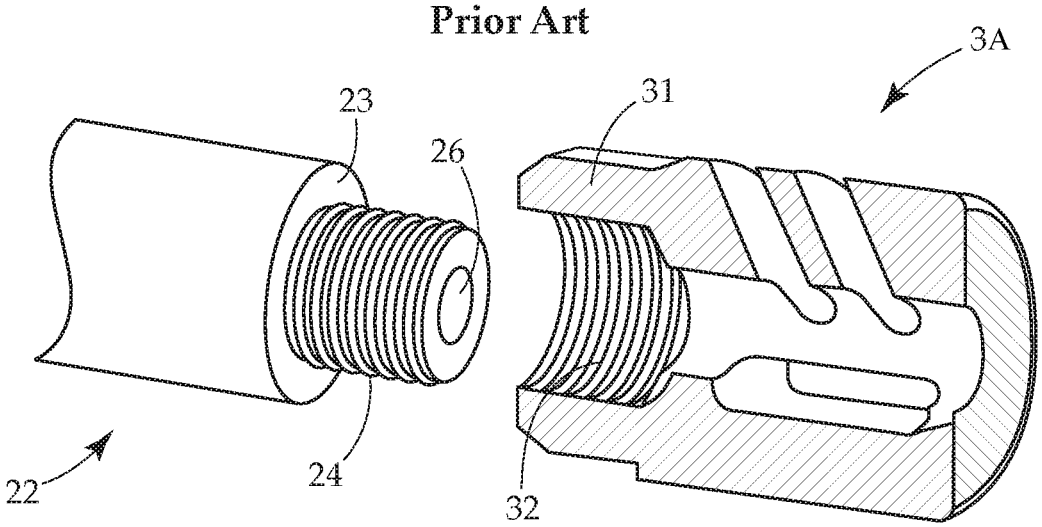
Fig. 1B Prior Art
FIG. 1B shows a prior art muzzle accessory.

Internally threaded muzzle accessories are generally attached directly to the discharge end of a rifle barrel via a corresponding threaded connection. as shown in FIGS. 1A-1B. Referring to prior art FIG. 1A, prior art accessory 3A is attached to rifle 2 the discharge end of the rifle barrel 22 of gun 2. Often however, the threads on the discharge end of the barrel do not perfectly align with the internal threading portion of the accessory leading to imperfect connections. When, for example, the accessory is not perfectly and concentrically aligned with the barrel, bullet trajectory can be negatively impacted. Referring to prior art FIG. 1B, rifles 2 designed to accommodate prior art muzzle accessories 3A have at the discharge end of barrel 22 a threaded barrel connection portion 24. Threaded barrel connection portion 24 generally has a diameter smaller than barrel 22 such that surface 23 extends outwardly from the barrel end of barrel connection portion 24 to barrel 22. Projectiles, i.e., bullets, exit rifle 22 through muzzle 26.

Still referring to prior art FIG. 1B, accessory 3A has accessory connection portion 31 having interior threaded cavity 32. Interior threaded cavity 32 has a diameter equal to the diameter of threaded barrel connection portion 24. Accessory 3A is connected to rifle 2 by threading interior threaded cavity 32 onto threaded barrel connection portion 24 such that a surface of accessory 3A abuts surface 23 of rifle 2. When connected, a bullet exiting muzzle 26 passes through the accessory 3A via tube 35 of accessory 3A. If accessory 3A is not properly aligned with barrel 22 such that muzzle 26 is perfectly concentric with tube 35, a bullet may strike tube 35 and create dangerous conditions.

Thus, to arrive at proper alignment, it is often necessary to thread prior art accessory 3A onto barrel 22 in a less than ideal manner. For example, to ensure muzzle 26 aligns with tube 35, the interior threaded cavity 32 of connection portion 31 of accessory 3A may only be partially threaded onto threaded barrel connection portion 24 such that no surface of accessory 3A abuts rifle surface 23. In such instances, alignment may be proper, but the connection obtained may not be secure.

Figure 1C:
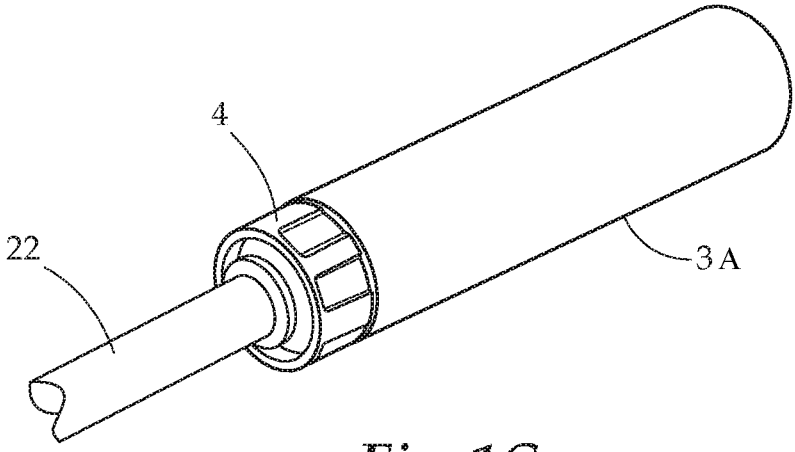
Fig. 1C Prior Art
FIG. 1C shows a prior art muzzle accessory assembly.

To achieve secure connection and proper alignment and referring to prior art FIG. 1C, it is therefore often necessary to resort to modifying the connection of the prior art accessory 3A to barrel 22 with additional parts 4. Parts 4 may include, but are not limited to, washers, shims, and set screws. As shown in prior art FIG. 1C, parts 4 are inserted on the threaded portion of the gun barrel in between the end of barrel 22 and accessory 3A. The use of these additional parts however still may lead to unsatisfactory results. Using parts 4 to force accessories 3A into proper connection and alignment can be tedious and time-consuming. Further, the force generated by propellant gases during firing exiting muzzle 26 can act on accessory 3A along tube 35, altering alignment and connection. Parts 4 used to initially align accessory 3A on barrel 22 generally do not allow for the type of fine-tuning of alignment of accessory 3A that may be desirable between rounds. Further, using parts 4 to achieve alignment of a first accessory 3A makes substituting a second accessory 3A difficult and time consuming as parts 4 must be removed and the alignment and connection process must be repeated all over again.

Figure 2A:
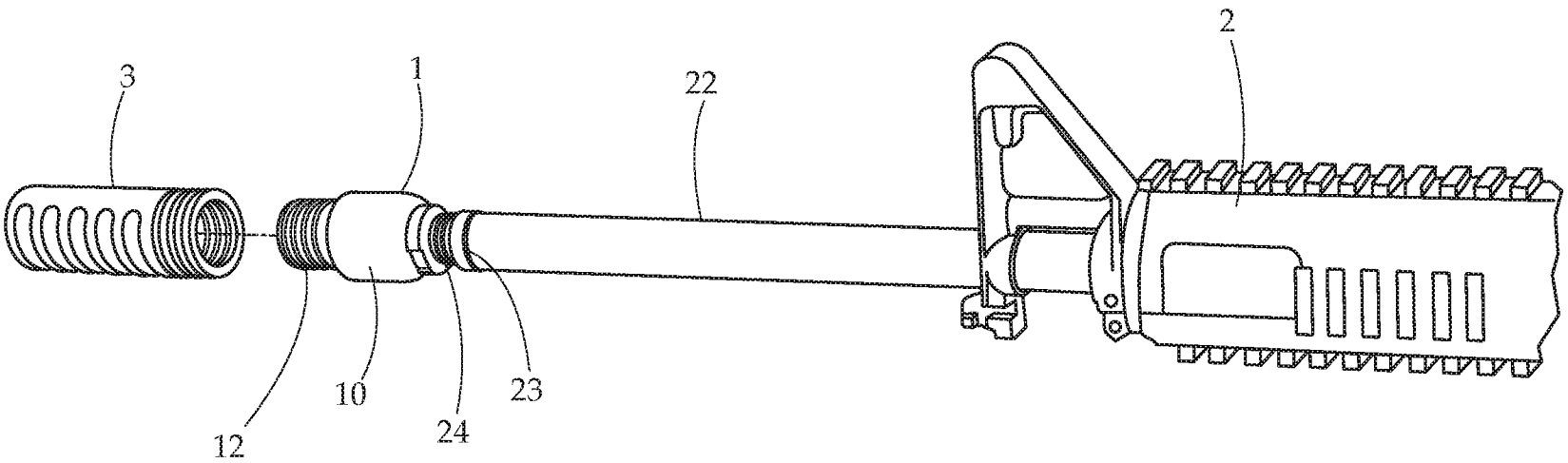
FIG. 2A shows a muzzle accessory connection device in use, in accordance with aspects and embodiments.
Figure 2B:
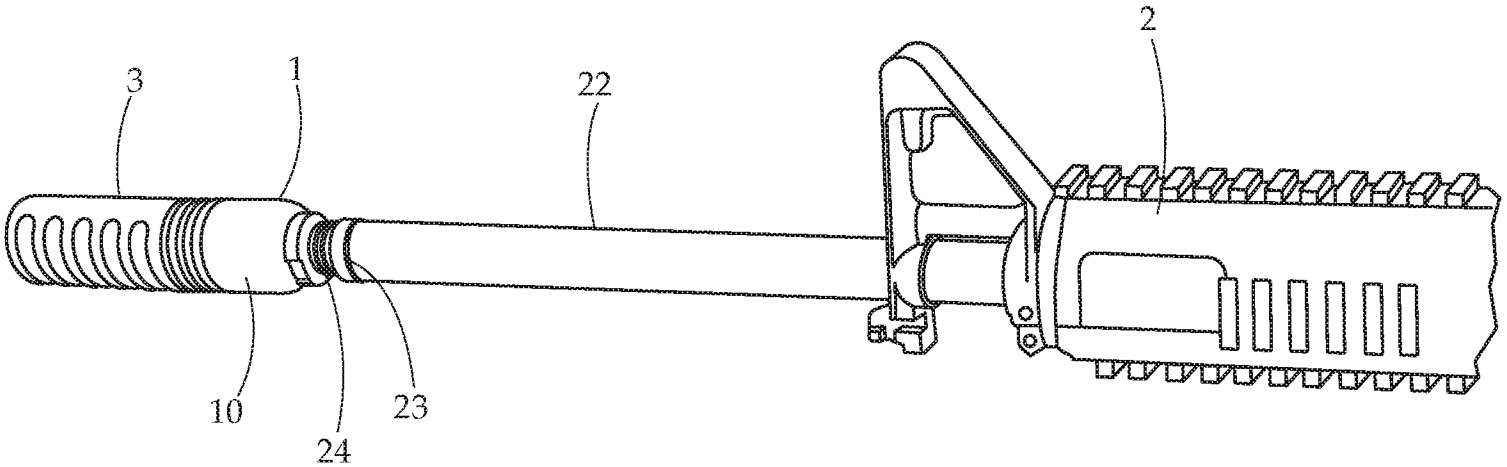
FIG. 2B shows a muzzle accessory connection device in use, in accordance with aspects and embodiments.

In accordance with aspects and embodiments of the present disclosure, a device is provided that facilitates a quick and precise connection of accessories to rifle barrels. Referring to FIG. 2A-2B, device 1 of the present disclosure fits on discharge end of rifle barrel 22 of rifle 2 and connects accessory 3 to rifle 2. As shown in FIG. 2A, device 1 has housing 10 and body 12. Threaded connection portion 24 of barrel 22 is positioned within housing 10. Body 12 of device 1 has a threaded surface and has a portion that extends from housing 10. Accessory 3 connects to device 1 via body 12 in the same manner than accessory 3 would directly connect to barrel 22 via threaded connection portion 24. As shown in FIGS. 2A-2B, device 1 may be positioned such that no portion of the device contacts surface 23 of barrel 22. Device 1 advantageously provides a secure connection between rifle and accessory regardless of the position of device 1 on threaded connection portion 24. Device 1 advantageously facilitates proper alignment of accessory 3 with barrel 22 and enables quick attachment and removal of accessory 3 such that other accessories may be interchanged as desired. Device 1 may be used with prior art muzzle accessories of the type 3A or may be used with modified accessories 3 in a muzzle accessory system, which may be provided to a user as a kit. Alternatively and as will be discussed herein, prior art accessories 3 may be modified with devices of the present disclosure for enhanced use with device 1 in a muzzle accessory system which may also be provided to users in the form of a kit.

Figure 3:
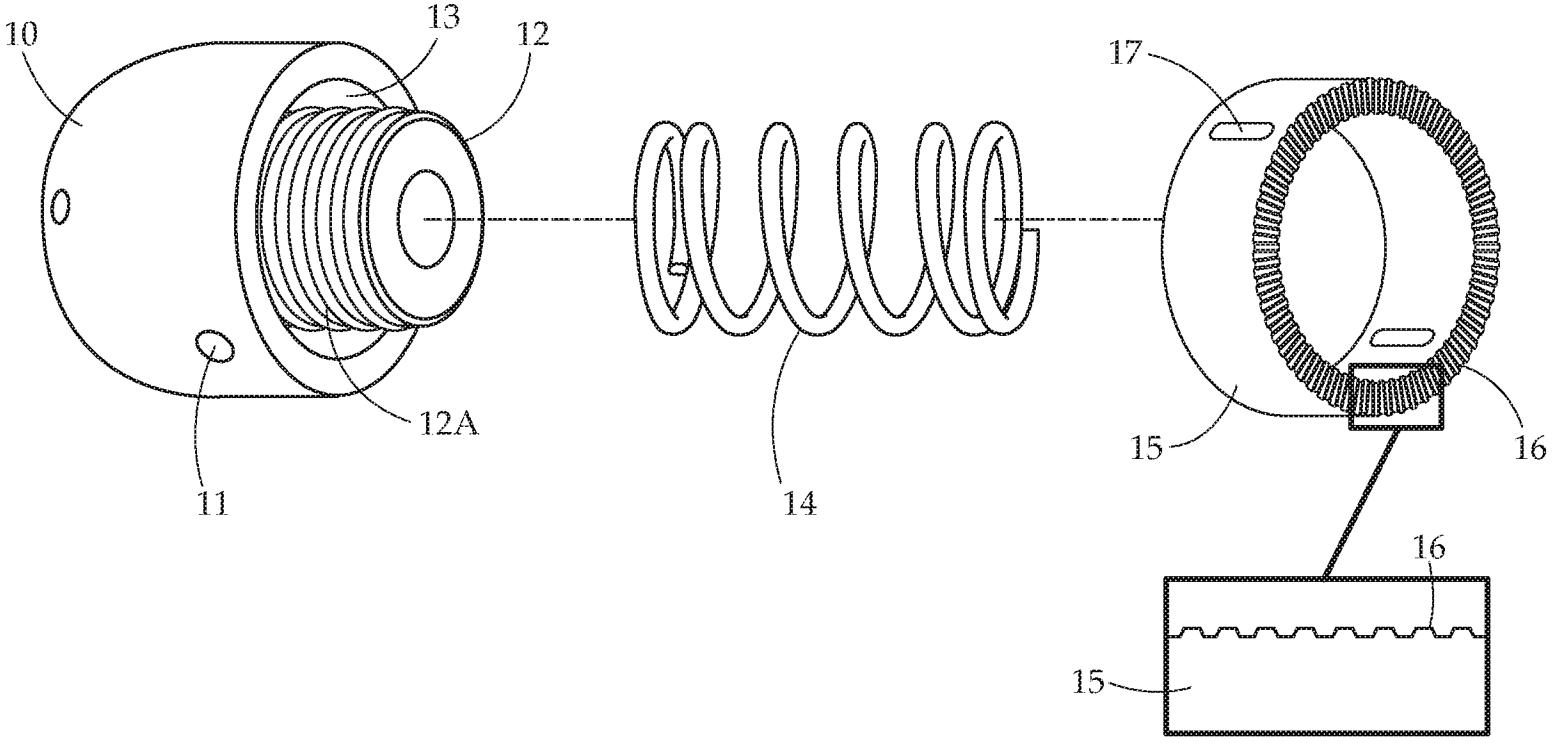
FIG. 3 shows an exploded view of a muzzle accessory connection device in accordance with aspects and embodiments.
Figure 4:
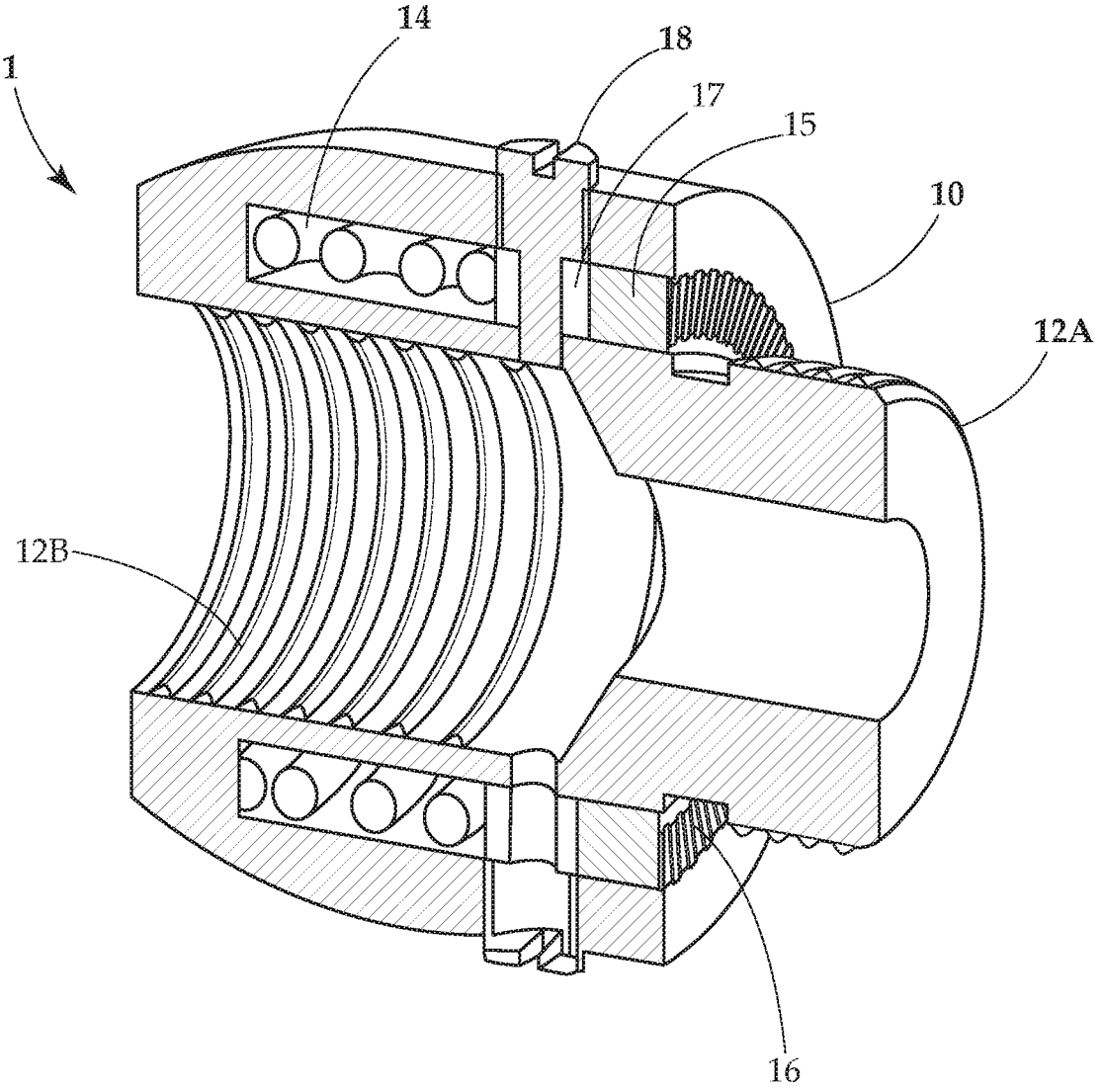
FIG. 4 shows a side cut-away view of a muzzle accessory connection device in accordance with aspects and embodiments.

FIG. 3 shows an exploded view of device 1. Device 1 has housing 10 formed of a substantially cylindrical outer wall and body 12. Referring also to FIG. 4, Body 12 has portion 12A and portion 12B, where portion 12B is completely contained within housing 10. At least a section of body portion 12A protrudes from housing 10. The diameter of the inner wall of housing 10 is greater than the diameter of body portion 12B, forming cavity 13 in device 1. Spring 14 has an inner diameter substantially equal to the diameter of body portion 12B and an outer diameter substantially equal to the inner diameter of housing 10 and spring 14 fits within cavity 13. Locking ring 15 has an inner diameter substantially equal to diameter of body portion 12B and an outer diameter substantially equal to the inner diameter of housing 10 and fits within cavity 13. When assembled and as shown in FIG. 4, through hole 11 on housing 10 aligns with corresponding locking hole 17 on locking ring 15. Device 1 may have a plurality of pairs of though holes 11 and locking holes 17. Through hole 11 has a diameter smaller than a diameter of locking hole 17. In some embodiments, locking hole 17 may be oblong or rectangular, and may have a length greater than the diameter of through hole 11 in the direction parallel to compression of spring 14. Referring again to FIG. 4, locking pins 18 extend into through holes 11 on housing 10 and through locking holes 17 on locking ring 15 to both hold spring 14 in a compressed state within housing 10 and hold locking ring 15 in cavity 13. Locking ring 15 is able to move a lateral distance in the direction of spring compression equal to the length of locking hole 17. In the exemplary embodiment shown in the drawings, locking ring 15 has radial 120° chamfer teeth 16, but any other suitable type of chamfer, gear tooth, bevel, or surface known in the art may be selected for use on locking ring 15.

Figure 5:
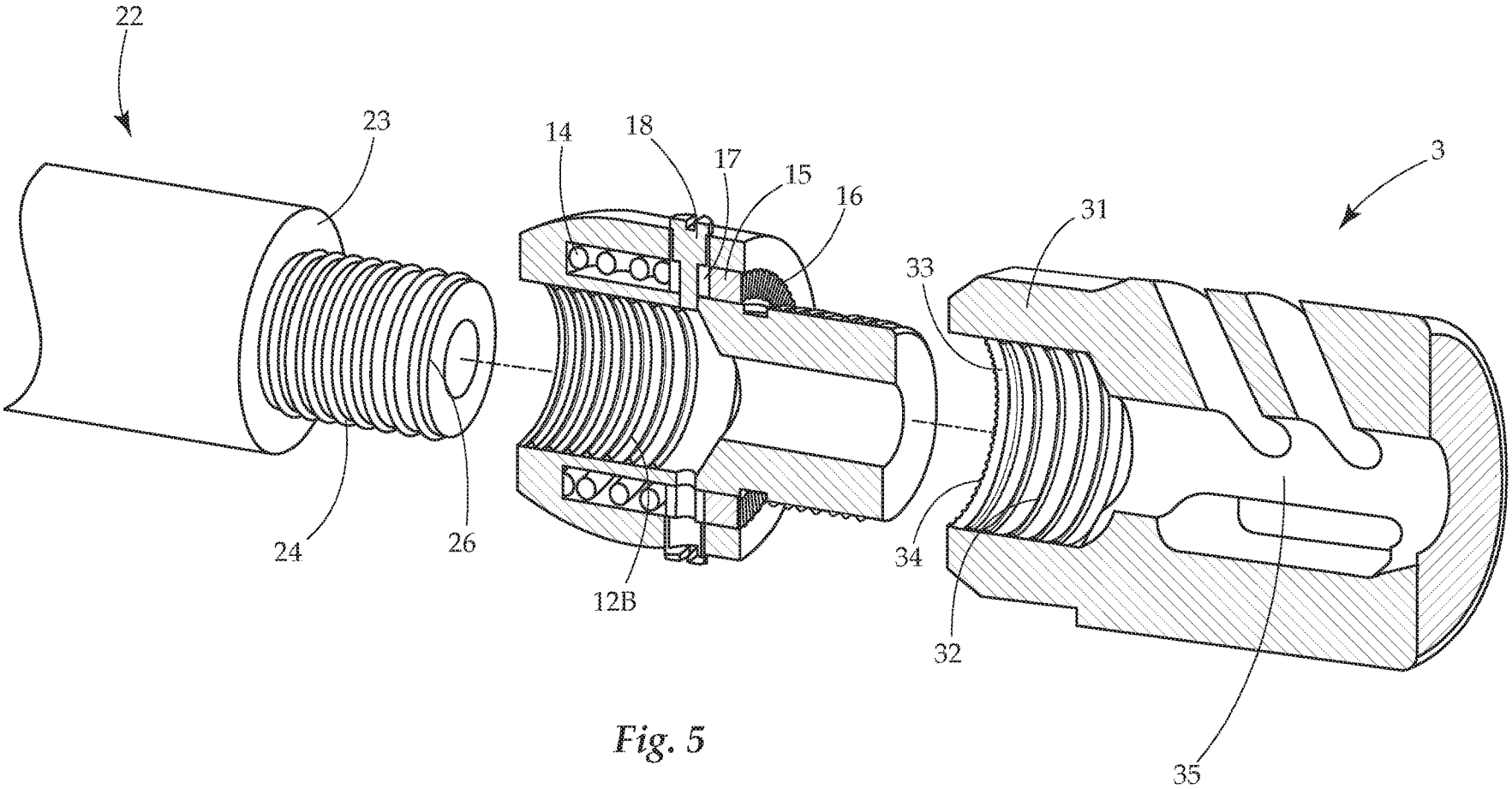
FIG. 5 shows a side cut-away view of a muzzle accessory connection device assembly in accordance with aspects and embodiments.
Figure 6:
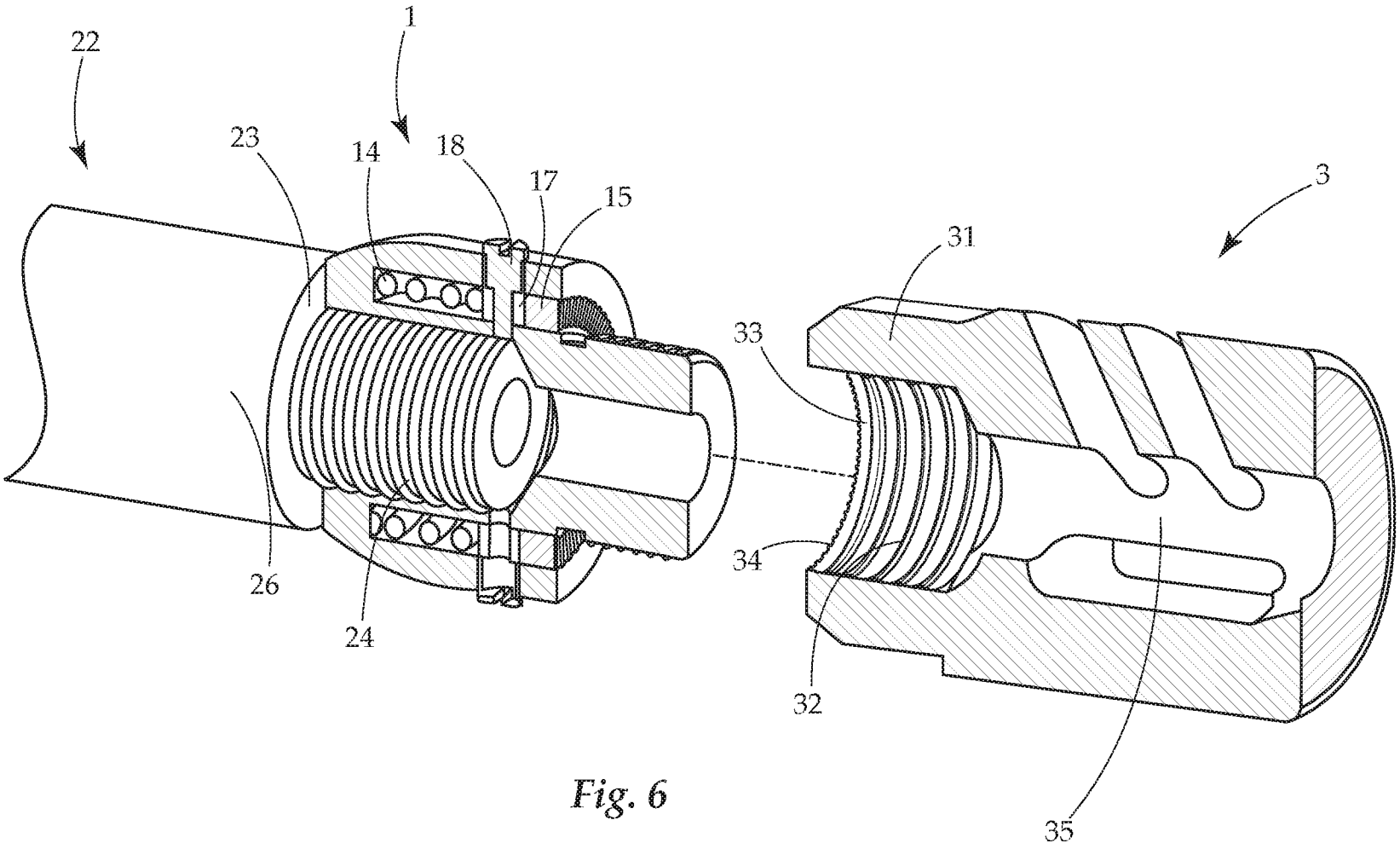
FIG. 6 shows a side cut-away view of a muzzle accessory connection device assembly in accordance with aspects and embodiments.
Figure 7:
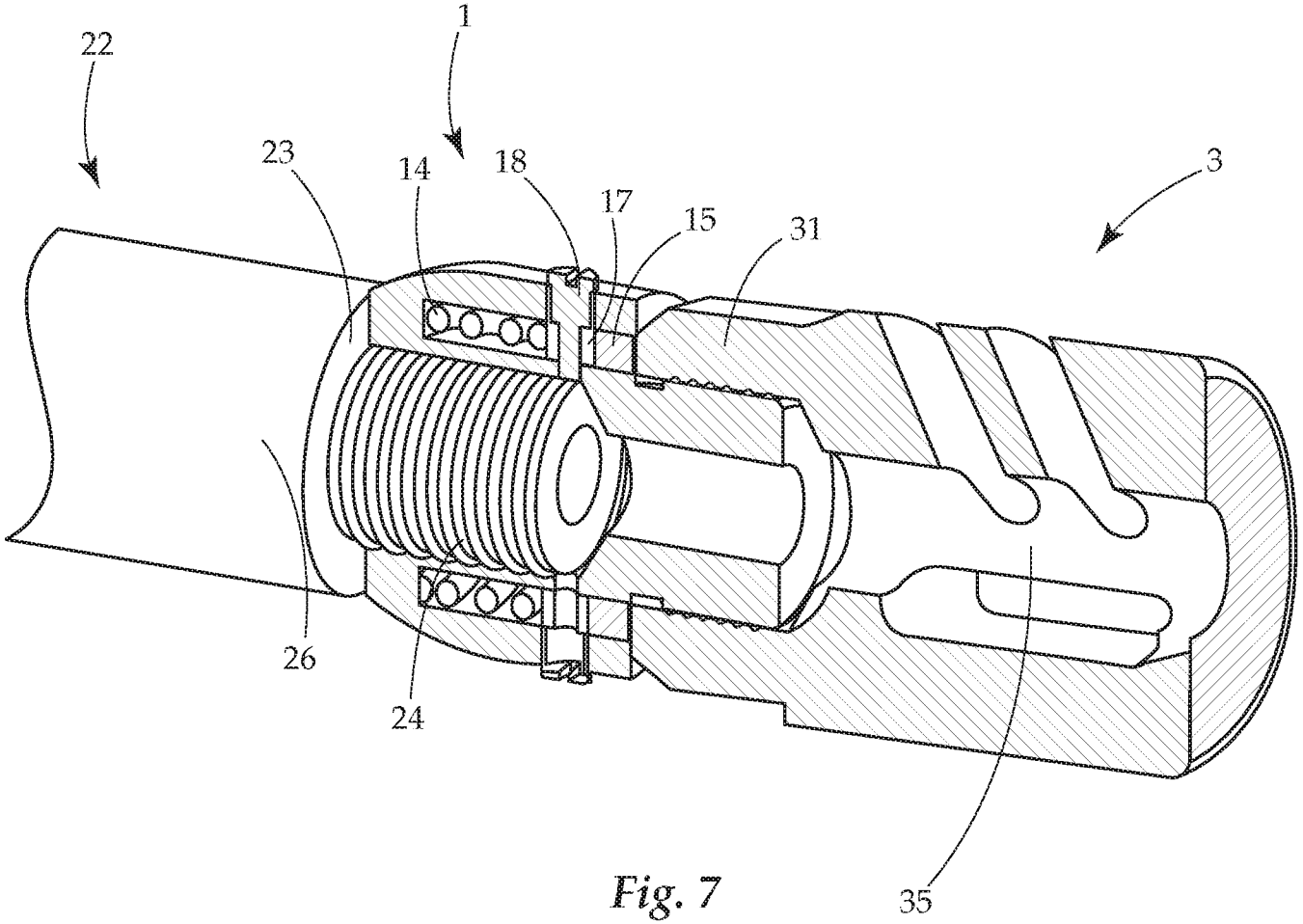
FIG. 7 shows a side cut-away view of a muzzle accessory connection device assembly in accordance with aspects and embodiments.

Referring now to FIGS. 5-7, device 1 mates with threaded connection portion 24 of barrel 22. As shown in FIG. 6, device 1 may abut surface 23 of barrel 22 or may thread onto only a section of threaded connection portion 24, giving the assembled configuration shown in FIGS. 2A-2B. Body 12 has body portion 12B within housing 10 of device 1. Body portion 12B defines a muzzle cavity that has an inner diameter equal to that of threaded connection portion 24. The inner surface of body portion 12B is threaded. Body portion 12B having a threaded muzzle cavity mates with threaded connection portion 24 to connect device 1 to barrel 22.

Body 12 has body portion 12A that extends from housing 10 of device 1. Body portion 12A has an outer diameter equal to the diameter of threaded connection portion 24 and a threaded external surface. Body portion 12A thus mimics threaded connection portion 24 of barrel 22 and mates with accessory 3 in the same manner that threaded connection portion 24 does in prior art FIGS. 1A-1B. Accessory 3 has attachment portion 31 having interior threaded cavity 32. Internal threaded cavity 32 has a diameter substantially equal to the diameter of body portion 12A. Accessory 3 further has chamfer teeth 34 (discussed further in reference to FIGS. 8A-8B). As shown in FIG. 7, Interior threaded cavity 32 receives body portion 12A of device 1 the threads on body portion 12A of device 1 mate with the threads of interior threaded cavity 32, thereby connecting device 1 to accessory 3.

Figure 8A:
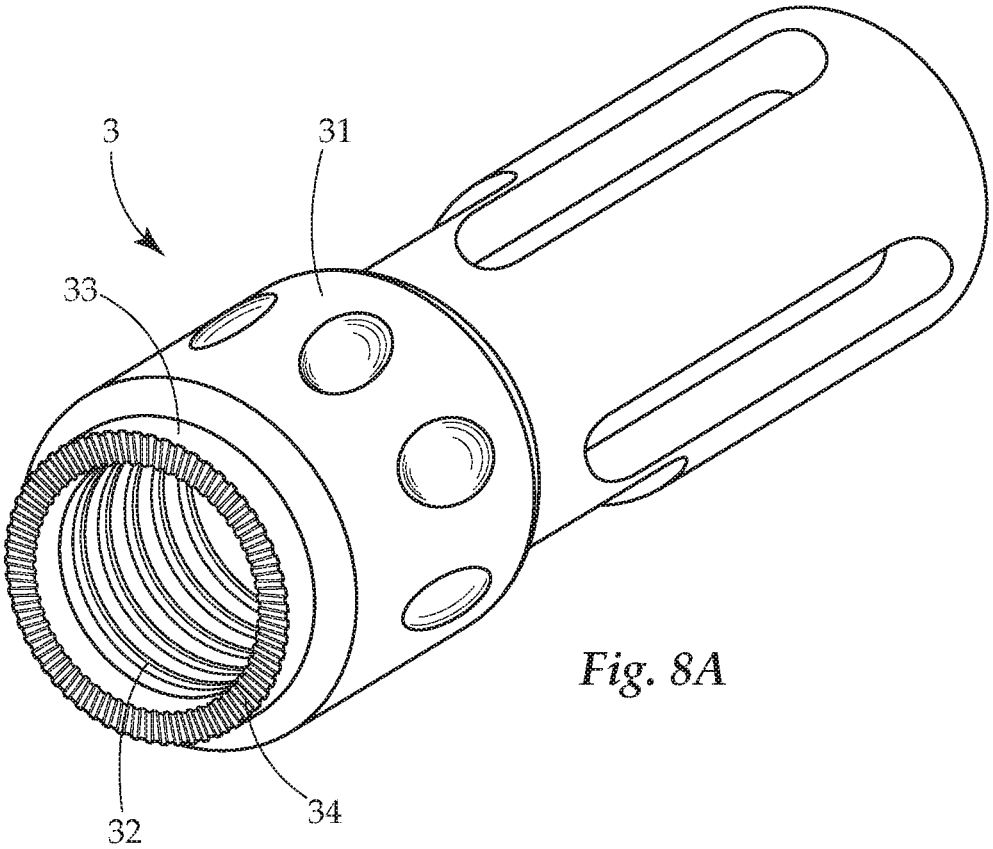
FIG. 8A shows a muzzle accessory in accordance with aspects and embodiments.
Figure 8B:
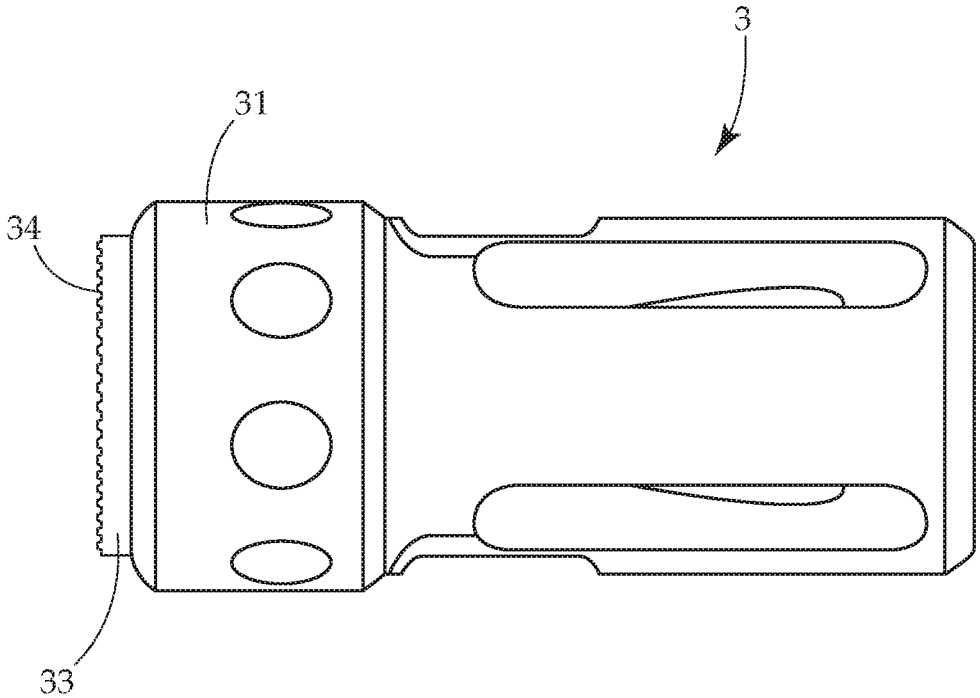
FIG. 8B shows a muzzle accessory in accordance with aspects and embodiments.

In accordance with aspects and embodiments, a modified muzzle accessory is provided for use with device 1. Referring now to FIGS. 8A-8B, accessory 3 has attachment portion 31 having interior threaded cavity 32 and attachment ring 33 having chamfer teeth 34. Chamfer teeth 34 are designed to engage with chamfer teeth 16 on locking ring 15.

As accessory 3 is threaded onto 12A and contacts locking ring 15 and chamfer teeth 34 on attachment ring 33 engage with chamfer teeth 16 on locking ring 15 and accessory 3 urges locking ring 15 towards spring 14. Spring 14 in turn applies compression on the side of locking ring 15 not in contact in accessory 3, which in turn applies force to accessory 3. The force applied by locking ring 15 on accessory 3 enhances the friction between the threads of body portion 12A and interior cavity 32. The enhanced friction between the threads results in a more secure threaded connection absent the application of force by locking ring 15.

In the event the connection achieved by threading interior cavity 32 onto body portion 12A does not result in proper alignment of muzzle 26 with tube 35, the engagement of locking ring 15 with an attachment ring 33 can be used to adjust the orientation of accessory 3 in finite increments until ideal alignment has been achieved. Chamfer teeth 17 on locking ring 15 engage corresponding chamfer teeth 34 on attachment ring 33. The connection of accessory 3 with device 1 can be adjusted by turning locking ring 15 one chamfer tooth at a time, or alternatively, turning device 1 on chamfer tooth at a time. In so doing, the connection is adjusted by a finite amount. The angular degree of movement achieved by rotating locking ring 15/attachment ring 33 a single chamfer tooth 16/chamfer tooth 34 will depend on the number and spacing of chamfer teeth 16/24 on locking ring 15/attachment ring 33.

Device 1 advantageously connects accessories at a position further away from the muzzle 26 than in traditional prior art systems. That is, accessories are connected not at threaded barrel connection portion 24, but instead at body portion 12A of device 1. This spaced connection distanced away from the muzzle along the projectile path advantageously reduces the risk of carbon lock between the accessory and device 1.

Figure 9:
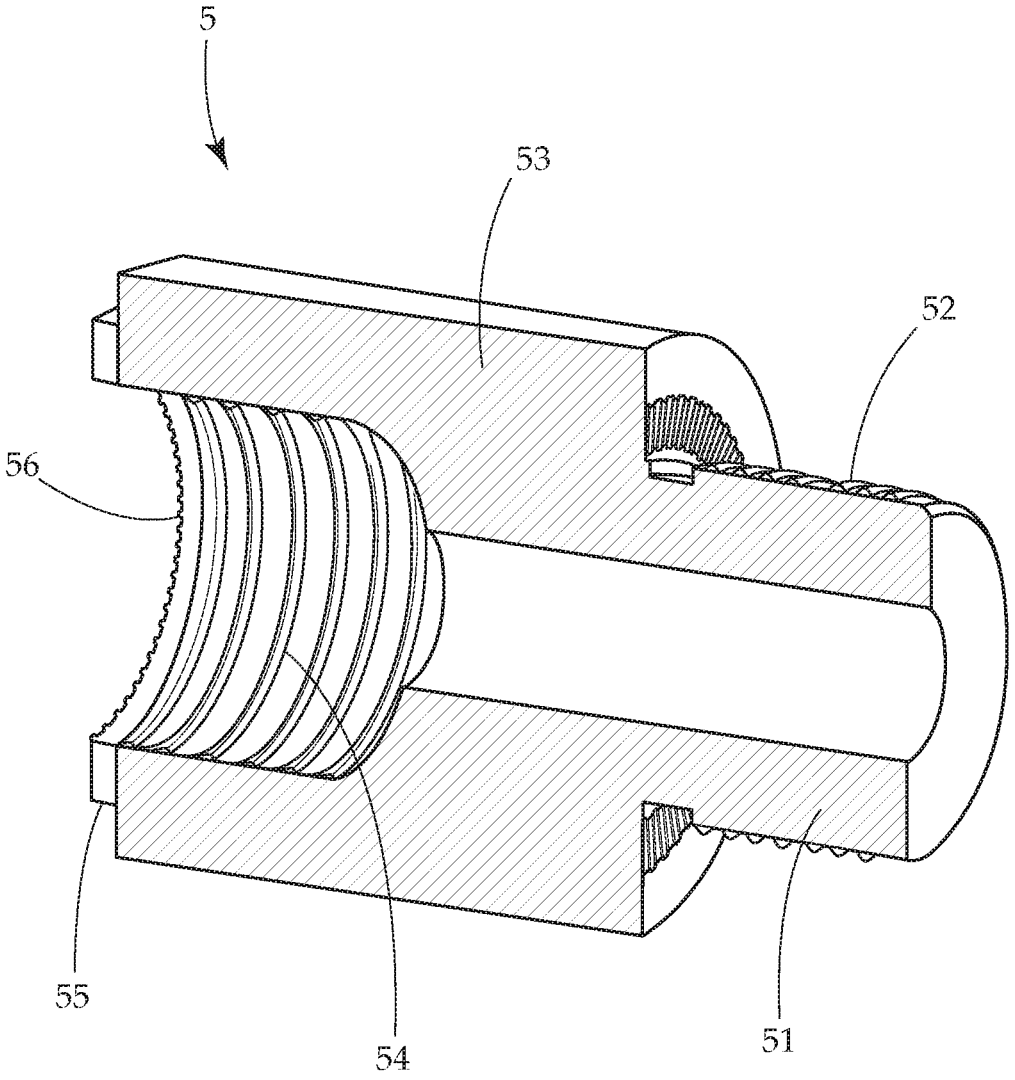
FIG. 9 shows a side cut-away view of a muzzle accessory adapter in accordance with aspects and embodiments.
Figure 10:
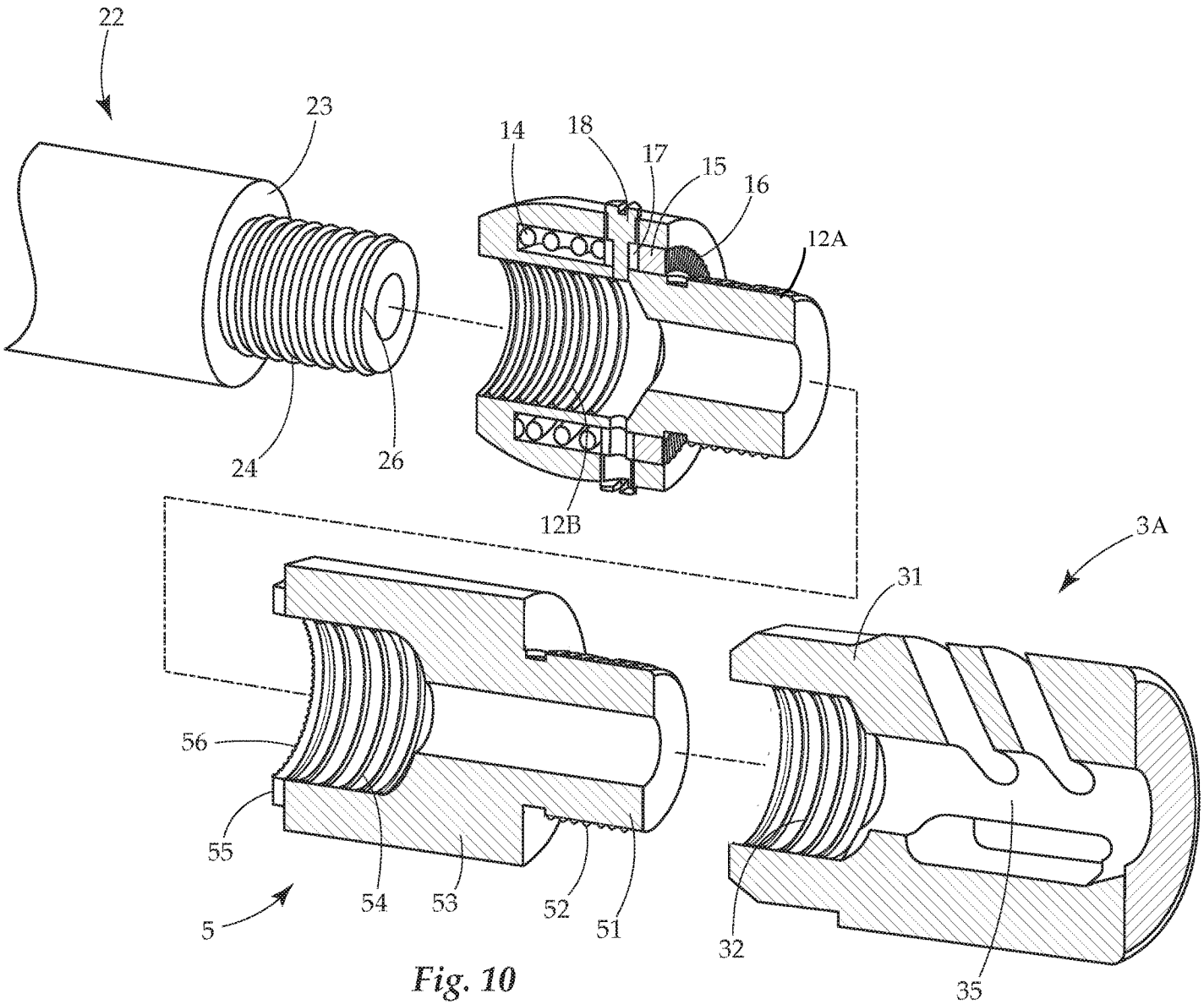
FIG. 10 shows an exploded side cut-away view of a muzzle accessory adapter and muzzle accessory connection device assembly in accordance with aspects and embodiments.
Figure 11:
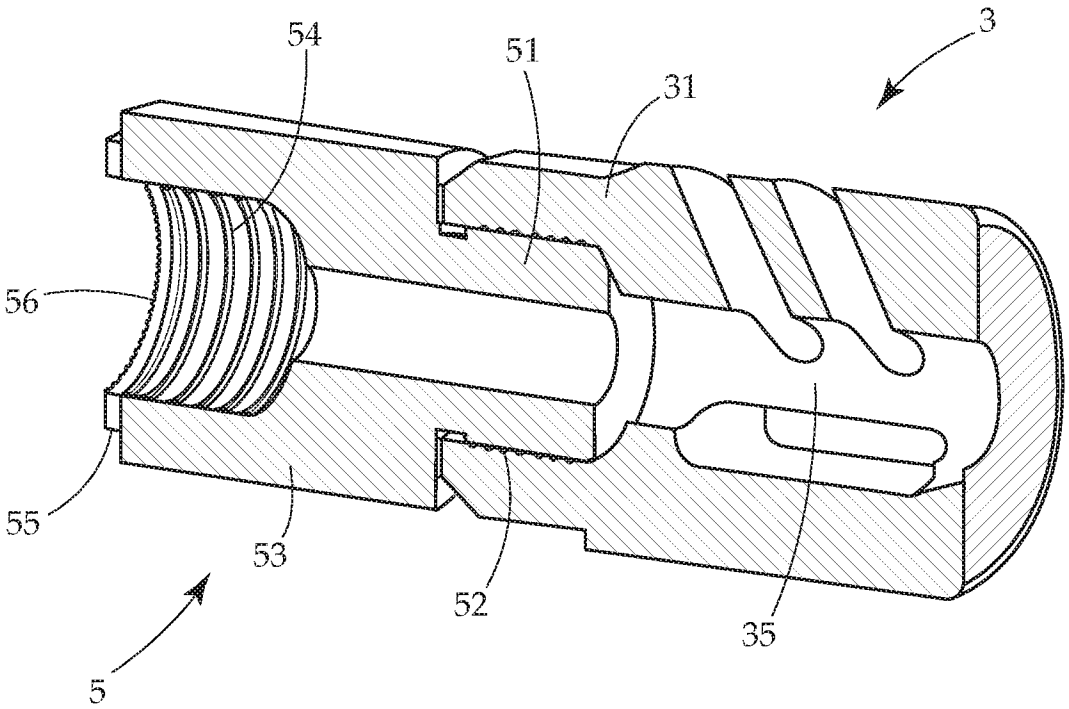
FIG. 11 shows a side cut-away view of a muzzle accessory adapter and a muzzle accessory assembly in accordance with aspects and embodiments.

In accordance with aspects and embodiments, an adapter is provided for use with prior art accessories. Referring to FIGS. 9-11, adapter 5 may be used with accessory 3A. Adapter 5 has body portion 53 having internally threaded cavity 54, body portion 51 having externally threaded surface 52, and attachment ring 55 have chamfer teeth 56. Portion 52 has a diameter substantially equal to the interior cavity 32 of connection portion 31 of accessory 3A. Threaded surface 52 mates with the threads 32 of accessory 3A, thereby connecting adapter 5 to accessory 3A, as shown in in FIG. 11.

Referring to FIG. 9, internally threaded cavity 54 of adapter 5 has a diameter substantially equal to body portion 12A of device 1. Adapter 5 is threaded onto body portion 12A od device 1 in the same manner accessory 3 is threaded onto device 1 to connect adapter 5 to device 1. Adapter 5 may be connected to device 1 when already connected to an accessory 3 or when not in connection with an accessory 3. The attachment ring 55 having chamfer teeth 56 of adapter 5 contacts locking ring 15 having chamfer teeth 16 device 1 and urges locking ring 15 towards spring 14. Spring 14 in turn applies compression on the side of locking ring 15 not in contact in adapter 5, which in turn applies force to accessory 5. The force applied by locking ring 15 on accessory 5 enhances the friction between the threads of body portion 12A and internally threaded cavity 54. The enhanced friction between the threads results in an enhanced threaded connection.

Although prior art accessories 3A can be used with device 1, adapter 5 advantageously modifies prior art accessories 3A to include the novel attachment ring having chamfer teeth such that the accessory can be incrementally adjusted to achieve optimal alignment. The chamfer teeth 56 on attachment ring 55 on adapter 5 interface in the same manner as the chamfer teeth on accessory 3. The chamfer teeth 56 engage with chamfer teeth 16 on locking ring 15 on device 1 to allow incremental adjustment of accessory 3A to achieve optimal alignment.

Although certain representative embodiments and advantages have been described in detail, it will be apparent to those skilled in the art that various modifications and variations can be made in the present disclosure without departing from the scope or spirit of the disclosure. Other embodiments of the disclosure will be apparent to those skilled in the art from consideration of the specification and practice of the apparatuses and methods disclosed herein. It is intended that the specification and examples be considered as exemplary only.

What is claimed is:

1. A muzzle accessory connection device comprising:

a housing having a first end and second end;

a body having a first body portion positioned concentrically in and contained within the housing and a second body portion extending concentrically from the first body portion and protruding from the second end of the housing;

a spring positioned in the housing and around the first body portion; and a locking ring positioned in the housing and around the first body portion;

wherein the device is configured to receive a discharge end of a rifle barrel at the first end of the housing and the second body portion is configured to mate with a muzzle accessory; and, wherein the housing comprises at least one through hole and the locking ring comprises at least one locking hole, and the at least one through hole and the at least one locking hole align and receive a locking pin.

2. The device of claim 1, wherein the locking ring exerts a force on the spring thereby compressing the spring towards the first end of the housing.

3. The device of claim 2, wherein the first body portion defines a muzzle cavity configured to receive a discharge end a rifle barrel.

4. The device of claim 3, wherein the muzzle cavity has a threaded surface.

5. The device of claim 4, wherein the second body portion is threaded.

6. The device of claim 5, wherein the locking ring comprises chamfer teeth.

7. A rifle accessory connection kit; the kit comprising:

a rifle accessory connection device comprising a housing having first end and a second end, the first end configured to receive a discharge end of a rifle barrel and the second end configured to connect to a rifle accessory, the rifle accessory connection device further comprising a locking ring having chamfer teeth; and a rifle accessory having a first accessory end and a second accessory end, the first accessory end configured to connect to the rifle accessory connection device at the second end and the first accessory end comprising an attachment ring having chamfer teeth;

wherein the chamfer teeth of the attachment ring are configured to engage the chamfer teeth of the locking ring; and, wherein the rifle accessory connection device further comprises a body having a first body portion positioned concentrically in and contained within the housing, a second body portion extending concentrically from the first body portion and protruding from the second end of the housing, and a spring positioned in the housing and around the first body portion, where the locking ring is positioned in the housing and around the first body portion.

8. The rifle accessory connection kit of claim 7, wherein the housing comprises at least one through hole and the locking ring comprises at least one locking hole and the at least one through hole and the at least one locking hole align and receive a locking pin.

9. The rifle accessory connection kit of claim 8, wherein the locking ring exerts a force on the spring thereby compressing the spring towards the first end of the housing.

10. The rifle accessory connection kit of claim 9, wherein the first body portion defines a threaded muzzle cavity and wherein the second body portion has an external threaded surface.

11. The rifle accessory connection kit of claim 10, wherein the rifle accessory has a connection portion that defines an internally threaded connection cavity having a diameter substantially equal to the diameter of the second body portion.

12. A rifle accessory connection kit; the kit comprising:

a rifle accessory connection device comprising a housing having a first end and a second end, the first end configured to receive a discharge end of a rifle barrel and the second end configured to connect to a rifle accessory, the rifle accessory connection device further comprising a locking ring having chamfer teeth; and a muzzle accessory adapter comprising a first body portion and a second body portion, the first body portion having a first end and a second end and defining an internal threaded cavity and the second body portion comprising an externally threaded portion, the muzzle accessory adapter further comprising an attachment ring at the first end of the first body portion, the attachment ring comprising chamfer teeth, wherein the first body portion and second body portion define a hollow core;

wherein the chamfer teeth of the attachment ring are configured to engage the chamfer teeth of the locking ring; and, wherein the rifle accessory connection device further comprises a body having a first body portion positioned concentrically in and contained within the housing, a second body portion extending concentrically from the first body portion and protruding from the second end of the housing, and a spring positioned in the housing and around the first body portion, where the locking ring is positioned in the housing and around the first body portion.

13. The rifle accessory connection kit of claim 12, wherein the housing comprises at least one through hole and the locking ring comprises at least one locking hole and the at least one through hole and the at least one locking hole align and receive a locking pin.

14. The rifle accessory connection kit of claim 13, wherein the locking ring exerts a force on the spring thereby compressing the spring towards the first end of the housing.

15. The rifle accessory connection kit of claim 14, wherein the first body portion defines a threaded muzzle cavity and wherein the second body portion has an external threaded surface.

16. The rifle accessory connection kit of claim 15, wherein the internal threaded cavity of the adapter has a diameter substantially equal to the diameter of the second body portion.

17. The rifle accessory connection kit of claim 16, wherein the externally threaded portion of the adapter is configured to mate with a muzzle accessory.

* * * * *